United States Patent [19]

Bergeron, Jr.

[11] Patent Number: 4,719,848

[45] Date of Patent: Jan. 19, 1988

[54] AIR CIRCULATION SYSTEM AND AIR FLOW ELEMENTS THEREFOR

[76] Inventor: Hervin J. Bergeron, Jr., Rte. 2, Box 224, Opelousas, La. 70570

[21] Appl. No.: 771,430

[22] Filed: Aug. 30, 1985

Related U.S. Application Data

[60] Division of Ser. No. 530,211, Sep. 8, 1983, Pat. No. 4,538,507, which is a division of Ser. No. 230,375, Feb. 2, 1981, Pat. No. 4,440,343, which is a continuation-in-part of Ser. No. 54,659, Jul. 3, 1979, Pat. No. 4,505,325, and Ser. No. 135,073, Mar. 28, 1980, abandoned.

[51] Int. Cl.[4] ..... F24F 7/00

[52] U.S. Cl. ..... 98/31; 126/400

[58] Field of Search ..... 126/400; 165/45, 48, 165/47.1; 52/585, 404, 406, 503, 596, 612; 237/69; 98/31

[56] References Cited

U.S. PATENT DOCUMENTS 3,922,832 12/1975 Dicker ..... 52/585

*Primary Examiner*—Henry A. Bennet

*Attorney, Agent, or Firm*—John F. Sieberth

[57] ABSTRACT

A network of adjacent aggregate containing mesh bags provides structural support to the slab or floor of a building. The network, encased in a sheath of plastic film, also functions as a path for air to be directed by a blower. The openings within the network are filled with gravel, sand or earth packs. At the perimeter of the network an air return system leads to the interior of the building. Thus, the blower can circulate air from the building interior through the network and air return system and back into the interior. Air circulating in the network can undergo heat exchange through the plastic film at the interfaces of the slab, the packs, and the underlying ground. Peripheral ground insulation minimizes lateral heat transfer. Preferably the aggregate containing mesh bags have indexing means to indicate their respective heights from above as they rest on a supportive planar surface.

14 Claims, 5 Drawing Figures

AIR CIRCULATION SYSTEM AND AIR FLOW ELEMENTS THEREFOR

REFERENCE TO RELATED APPLICATIONS

This application is a division of application Ser. No. 530,211, filed Sept. 8, 1983 (now U.S. Pat. No. 4,538,507 issued Sept. 3, 1985), which in turn is a division of application Ser. No. 230,375, filed Feb. 2, 1981 (now U.S. Pat. No. 4,440,343 issued Apr. 3, 1984) which in turn is a continuation-in-part of my prior copending application Ser. Nos. 54,659, filed July 3, 1979, (now U.S. Pat. No. 4,505,325 issued Mar. 19, 1985), and 135,073, filed Mar. 28, 1980 (now abandoned), all disclosures of both said last-mentioned applications being incorporated herein as if fully set forth.

BACKGROUND OF THE INVENTION

1. Field of the Invention

The present invention relates to air circulation systems for generally enclosed structures such as homes having a floor and wall portions.

The present invention more particularly relates to an improved heat transfer and air circulation system for homes and like construction wherein use is made of a non-heat conductive aggregate structural circulation medium capable of both supporting the home and transmitting circulating air from the home through the air spaces in the aggregate medium to enable heat transfer to take place between the air and the adjacent underlying soil mass and between the air and the adjacent overlying slab or floor of the home.

2. General Background and Prior Art

In homes and other like constructions, fossil fuels or other energy is spent usually in the form of generated electricity for heating and cooling of the home. The average home requires energy which is ever shrinking and ever more expensive for its comfortable climate control.

There is a need for a more efficient system for heating and cooling the home which will allow it to be more efficiently and less expensively temperature controlled without the excessive use of electricity, fossil fuels or other consumed energy.

Most homes are of a slab type construction, meaning that the home sits on a probably four to six inch thick mass of concrete, which is poured on the ground (and some distance below in many cases) providing a structural support for the home. Other secondary support such as piling can communicate with the slab to provide a structural base which will not sink under the load of the home and the slab itself.

In most climates, the temperature in the ground under the slab differs from the temperature of the atmosphere around the home and is at or close to the temperature desired in the home. For example, during the heat of the day the soil beneath the home is usually many degrees cooler. Further, in the winter the outside air is usually much cooler than the ground a few inches or feet below the ground surface. Indeed, it is recognized that a "frost line" exists below which pipes and other matter will not freeze.

In summer, a few inches or feet below the slab of the home cooler temperatures exist than in the atmosphere around the home. Usually, the earth or soil at the frost line has a relatively constant temperature all year long.

It would thus be desirable to circulate air through a medium provided below the home and return it to the inside of the home to either supplement the existing cooling system in the home or provide the total cooling system therefor. In winter, heating could be accomplished by circulating air taken from the home to the relatively constant temperature earth, and returning that air to the interior of the home.

Many devices have been patented, which have attempted to solve the problem of air circulation and climate control within homes and similar inhabitable constructions. Many of these devices have provided a medium of some sort beneath the ground through which air can be circulated and heat transfer effected.

Some prior art devices require complex structural support for the home or construction. Others do not have adequate detention time provided by their circulation medium for the circulated air to effect proper heat transfer. Still others require deep excavations or complex equipment, or both, and thus would be difficult and expensive to install.

In the heat transfer media provided or suggested by some prior art devices/systems, heat conductive material is used, allowing premature heat transfer to occur before air currents reach the underlying earth. Thus, "hot spots" are created in the circulation medium.

Some systems suffer from undersirable heat transfer to or from the surroundings.

Heating or cooling of the floor area which contacts sensitive human extremities (as feet) is not achieved by prior devices without inefficient and expensive supplemental conventional heating or cooling.

GENERAL DISCUSSION OF THE PRESENT INVENTION

The present invention solves the prior art problem and shortcomings in a very simple and inexpensive manner by providing an effective and workable heat transfer thermal cap system for use under the floor or slab portion of a home to be heated and cooled. In addition, this invention provides an air circulation system for use with generally enclosed structures, such as homes, and the like having at least enclosing walls and roof. The apparatus includes a blower for circulating air between the enclosed structure interior and a provided void air space. An aggregate mass of relatively non-conductive, structural air circulation material partially occupies the void air space and is positioned under the slab or floor portion of the structure so that the material also communicates with the underlying earth. The circulation mass provides structural support to the home or like construction with the uppermost portion of the aggregate mass communicating with and supporting at least a portion of the slab or floor of the enclosed structure. A water barrier film sheet envelope surrounds the aggregate mass and prevents water flow into the aggregate mass from the surrounding area. The envelope also assists in confining the air flow within the aggregate mass. A plurality of air return lines or conduits are provided to the aggregate mass, each having a discharge port at one end portion thereof communicating with the inside portion of the enclosed structure. Air intake means are provided for collecting air within the aggregate mass and transmitting that air through the conduits to the discharge ports under the urging of the blower. The apparatus may further comprise independent flow control means associated with each of the air return lines. Such flow control means may be of various types. For example, they may comprise adjustable louvers or dampers to control the volume of air flow from the respective discharge ports. Preferably, the flow control means comprise a suitable length of perforated pipe communicating with the air return lines, the perforated pipe being mounted in or adjacent to the aggregate mass.

In the method of operation, there is provided a preferably expanded clay lightweight aggregate mass on the underside of an enclosed structure which mass communicates over substantially its entire area with both the floor/slab portion of the building being supported and heated or cooled as well as with the earth therebelow. The aggregate material of the mass has a high "R" factor and is itself a poor conductor of heat. Air is blown from the inside of the generally enclosed structure through an opening in the floor portion thereof to the aggregate mass and circulated through the aggregate mass. Heat is transferred between the circulated air and the earth below the aggregate mass and between the circulated air and the slab/floor above the aggregate mass. Water is excluded from the aggregate mass and thus except for some condensation which may occur in humid climates with cool circulated air, the mass is maintained in a substantially anhydrous condition. To this end, water of condensation, if any, is drained from the mass substantially as it is formed. Circulation air is collected in the aggregate mass and distributed to the interior of the building in a plurality of preferably balanced flow independent air return lines.

Means can be provided for collecting heat from various heat producing elements within the structure, such as fireplaces, dryers, ovens, stoves, space heaters, and the like. Such collected heat in the form of heated air can be transferred by means of ducts, conduits, or the like to the blower intake portion for circulation into the aggregate mass where heat transfer will store some of the collected heat in the earth beneath the mass. Heat transfer to the heat conducting slab may also occur.

For best results, a small heating unit such as an electrical heating coil is positioned in the blower unit so that a small amount of heat may be added to the intake air as desired during periods of cold weather. Similarly, it is also desirable, especially in humid localities, to include a small cooling coil in the blower unit so that the circulating air may be cooled somewhat during periods when the exterior temperatures are high. For a home having a living area of about 1000 square feet, a 5-kilowatt heating coil and a one-ton (12,000 btu) cooling coil are entirely sufficient for these purposes.

In another embodiment of this invention a solar collector is associated with the structure so that water, air, or other fluid can be heated by solar energy. The heat collected in this manner can be readily transferred to the air being circulated through the enclosed structure thereby furnishing such additional heat as may be needed or desired in connection with the operation of the system as a whole.

Thus, it is an object of the present invention to provide a heat transfer system for homes and like construction which evenly distributes collected heated or cooled air through an aggregate mass for even heat transfer with the earth generally beneath the aggregate mass.

It is another object of the present invention to provide a heat transfer system in which such an aggregate mass furnishes at least a part of the structural support to the building to be heated or cooled.

Another object of the present invention is to provide a heat transfer system which is simple and easy to construct and easy to maintain.

Still another object of the present invention is to provide a heat transfer system which collects wasted heat generated by various heat producing units within the home or like construction such as the fireplace, stove, oven, dryer, and the like, and transfers this heat to a system maintained below the slab or floor thereby maintaining a desirable thermal equilibrium.

A further object of the present invention is to provide an apparatus for collecting wasted heat within the home and transferring the excess wasted heat in the form of heated air to a blower for transfer to a body of air being continuously circulated between a continuous void air space, partially occupied by an aggregate mass provided beneath the home, and the interior of the home.

Yet another object of the present invention is to provide an insulated thermal cap between the home to be heated and cooled and the earth beneath the frost ine whereby heat can be added or taken away from the relatively constant temperature earth beneath the home as needed.

It is a further object of the present invention to provide an air circulation medium beneath the home and communicating with the slab/floor portion to maintain a desirable temperature in the slab/floor region.

Still another object of the present invention is to provide a heat transfer means which is easy to construct and which evenly transfers and distributes heat without excessive hot spots or localization of heat buildup.

It is another object of the present invention to provide a thermal cap heating and cooling construction for use with homes and like constructions which reduces the cost of heating and cooling of the structure and saves energy and money as compared with conventional heating and cooling systems.

Yet another object of the present invention is to provide a heating and cooling transfer system which eliminates attic duct work as provided in conventional heating and cooling systems.

It is a further object of the present invention to provide a heat exchange system which can incorporate a fire alarm, fire prevention system, and purification and/or deodorizing system for use with an overall air circulation system.

It is still a further object of the present invention to provide an air circulation path which moves through a controlled temperature circulation medium at or near an ideal comfortable temperature level, negating the chance for undesirable heat or cooling loss to the ambient air.

Still another object of the present invention is to provide an air circulation system useful during both cold winter and hot summer outdoor environments.

Yet another object of the present invention is to provide an air circulation system featuring a non-conductive circulation medium which baffles air flowing therethrough to maximize air detention time and thus maximize heat storage capability while minimizing the chance for hot spots, convection currents and the like.

A feature of the present invention is that the slab/floor of the home is warmed (in winter) or cooled (in summer) giving comfort to the feet, and lower extremities of the habitant.

Another feature of the present invention is the warming/cooling in winter/summer respectively of fixtures resting on the slab/floor as such is kept at a pleasing temperature level.

Another feature of the present invention is that heat surges from intense heat generation sources as stoves, ovens and the like are quickly dissipated.

Another feature of the present invention is that the system may be installed during home construction with little or no cost increase.

These and other objects and features of this invention will be apparent from the disclosure herein.

DETAILED DESCRIPTION OF THE PREFERRED EMBODIMENT

Figure 1:
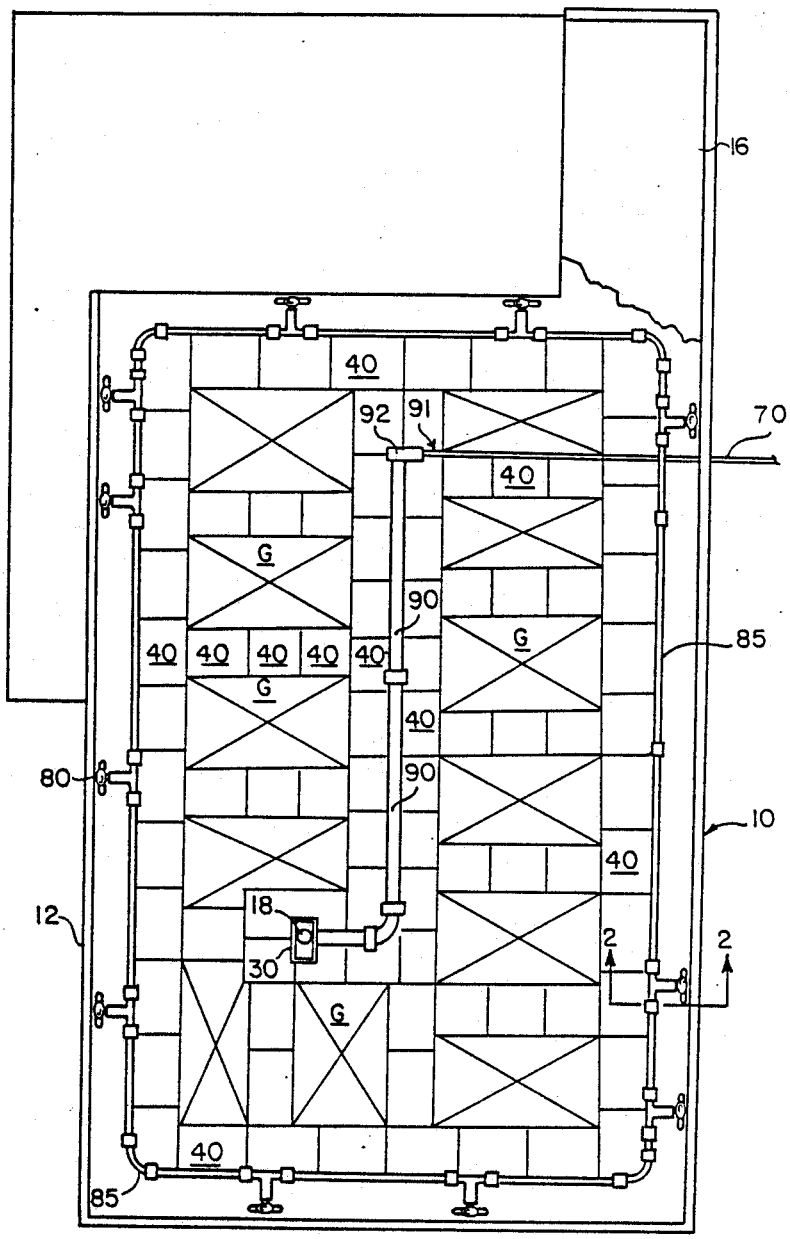
FIG. 1 is a top sectional view of a preferred system of the present invention.

In FIG. 1 there is seen a top sectional view of a home 10 or other generally enclosed structure having a slab 16 upon which are supported perimeter wall 12 and blower unit 30. Slab 16 is shown broken away so as to expose to view the apparatus normally positioned thereunder. Blower unit 30 is positioned at a suitable location in home 10 and has an opening 18 which communicates with plenum 90 which underlies slab 16. Plenum 90 may be, for example, an eight inch perforated pipe having a drain unit 91 which comprises a cap 92 having an opening communicating with drain pipe 70 for removing any moisture collected therewithin. Blower unit 30 preferably contains a small heating unit and a small cooling coil system so that appropriate heat transfer may be steadily and gradually effected with the circulating air as it passes through unit 30. An important feature of this invention is the fact that such heating and cooling units may be much smaller than the heating and cooling units required in conventional systems for heating and cooling the same sized building. For example, in the systems of this invention a 5-kilowatt heating coil and a one-ton (12,000 btu) cooling coil are entirely adequate for each 1000 square feet of interior living area in homes constructed in the Gulf Coast region of the United States.

A plurality of aggregate containing bags 40 made at least in part of strong mesh are arranged in duct-like fashion in rows along the perimeter of home 10 and in cross-duct fashion connecting with the aggregate containing bags 40 adjacent plenum 90.

Gravel, sand or earth packs G are positioned between the duct-like network established by bags 40. Packs G may be formed by placing gravel, sand or earth at appropriate locations on the ground surface so that the channels for bags 40 are formed above ground level. Alternatively, shallow channels for bags 40 may be excavated into the ground whereby the earth remaining between the channels serves as the packs G. To avoid undue repetition, the number 40 has been applied to only a small number of the aggregate containing bags schematically depicted in FIG. 1. Likewise, only a few of the packs have received the identifying letter G. In general, the areas occupied by the packs are marked with a pair of crossed lines, the remaining areas being occupied by the aggregate containing bags.

Figure 2:
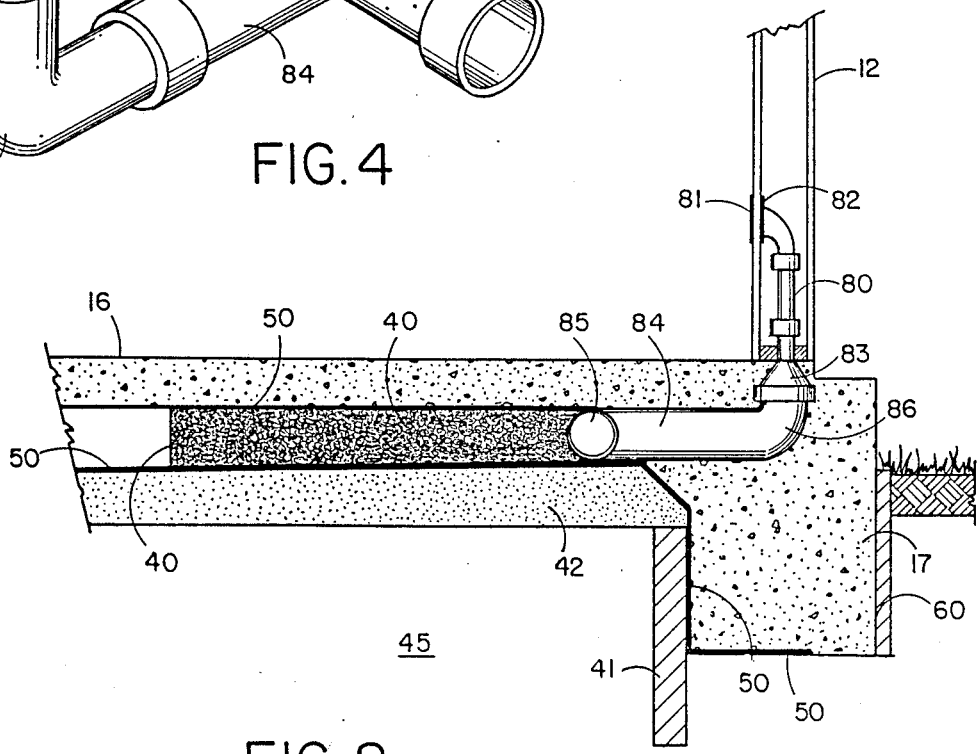
FIG. 2 is a sectional view taken along lines 2—2 of FIG. 1.

FIG. 2 shows a partial sectional view of an edge portion of the preferred embodiment of FIG. 1. Thus, FIG. 2 shows perimeter wall 12 and floor or slab 16 which may be, for example, a four inch thick concrete slab. Underlying slab 16 is film sheet 50 which may be for example 6 mil polyethylene film or any other suitable plastic sheeting relatively impervious to air and water.

Underlying slab 16 and upper film sheet 50 is a generally horizontal air flow space occupied by bags 40, with packs G lying in the same general plane forming a network configuration such as shown in FIG. 1. In FIG. 2, a pack G does not appear.

Underlying the air flow space which is normally occupied by bags 40 is additional film sheet 50 under which there is, for example, sand fill 42 graded as desired to provide any desired slope for enhancement of water removal.

Perimeter footing 17 of, for example, reinforced concrete provides peripheral support to slab 16 and may be integral therewith (as shown) or may be poured separately. Adjacent the entire perimeter of footing 17 are inner perimeter insulation 41 and outer perimeter insulation 60. In regions where freezing temperatures are experienced during the winter, it is preferable to have at least one of these perimeter insulations extend to below the frost line. Such perimeter insulation, which may consist of any suitable decay-resistant thermal insulation substance such as foamed plastic material, minimizes or prevents lateral heat exchange as between the earth outside the perimeter of the building and the earth (and sand layer 42 when used) subsurface to the air flow space occupied by bags 40. It will of course be readily apparent that it is not necessary to employ two perimeter insulations—one of them is entirely sufficient in most localities. When only one perimeter insulation is used, it should extend down to below the frost line, if any.

Figure 4:
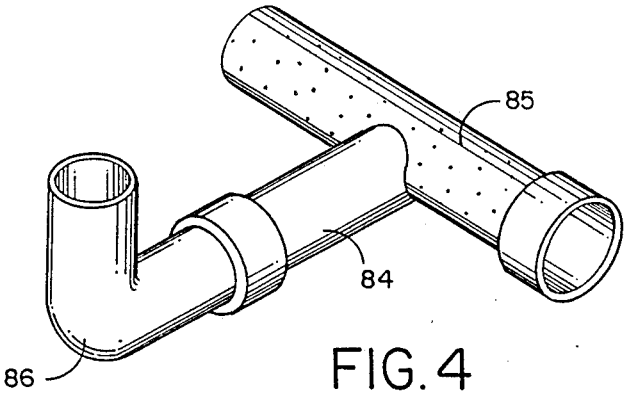
FIG. 4 is a view of a portion of an air return line of the system of FIG. 1.

Perforated air return line 85 extends around the perimeter of the air flow space occupied by bags 40 (note FIG. 1). The perforations in line 85 (note FIG. 4) permit the intake of air being circulated through the aggregate by means of blower unit 30. Connected at spaced intervals to line 85 are tee lines 84 each having an upwardly turned elbow 86 connected to reducer 83 leading to line 80 and thence to return air outlet 81 via inwardly turned elbow 82. Each outlet 81, which may be equipped with adjustable or fixed louvers or the like (not shown), communicates with the interior of building 10 preferably at a location above but in proximity to the upper surface of the slab or interior flooring (note FIG. 2). As can be seen from FIG. 1, perforated line 85 serves as a header or manifold in that it transmits the flow of air to a plurality of individual tee lines 84 leading ultimately to a plurality of individual return air outlets 81 arranged at suitable locations around the periphery of the interior of the building. Thus, air taken in by blower unit 30 at opening 18 is passed into plenum 90 from which it is distributed into the bed of porously bagged aggregate 40 at a suitable location. The air then passes through various portions of the aggregate network aided by the biasing action of packs G and film sheet 50. The air flowing in this manner is able to effect heat exchange with sand layer 42 (if used), packs G, the earth 45 underlying the slab or floor 16, and also with the overlying slab 16. Thereupon, the flowing air is collected in line 85 and transmitted to the air return outlets 81. In the interior of the structure 10, the continuous flow of air proceeds from the perimeter (the location of the outlets 81) toward the generally centrally positioned blower opening 18. Thus, heat exchange through the perimeter walls 12 is kept to a minimum.

It will be noted that overhead duct work and its attendant insulation commonly used for central heating and air conditioning systems can be eliminated.

Figure 3A:
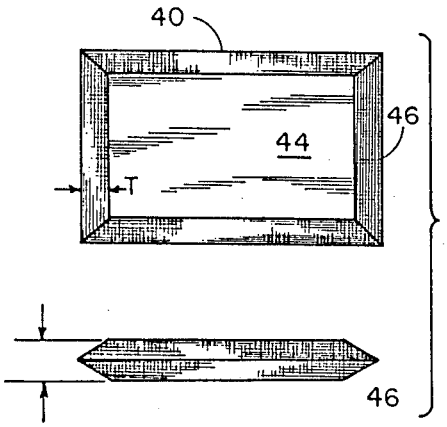
FIGS. 3A and 3B are top and front views respectively of two aggregate filled bags of the present invention, the bag of FIG. 3B containing about twice as much aggregate as the bag of FIG. 3A.
Figure 3B:
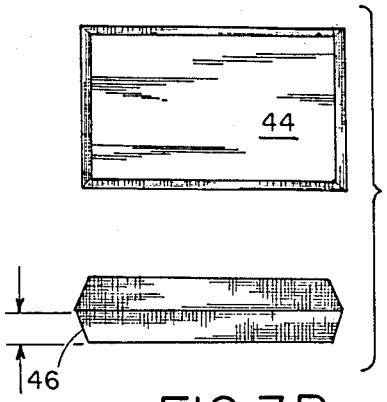

FIGS. 3A and 3B illustrate more particularly the construction of aggregate containing bag 40. The bags themselves are made from a nylon or other strong mesh material having, for example, a one-quarter inch mesh size and are filled with a lightweight aggregate of the type referred to in the ASTM standards by the designations C331-64T and C330-68T. The aggregates preferably have a grain size between 0.5 and 1.5 inches. When tightly packed together less than 50 percent of the volume occupied by a body or mass of aggregates of this grain size is solid material, the balance being a continuous void air space. Particularly preferred aggregate material is expanded clay aggregate. One such material is known in the industry by the tradename "Gravelite".

FIGS. 3A and 3B illustrate yet additional features of this invention, namely that the bags of a given size may be filled with differing amounts of an aggregate so that they will vary in height or thickness and further and preferably, that indexing means can be utilized on the bags to indicate their respective heights (thicknesses) from above as they rest on a supportive plane-like surface. Thus, FIGS. 3A and 3B depict two aggregate containing bags 40 of equal size when empty. Both bags are fabricated from mesh 46 and have affixed to their top and bottom surfaces plastic film sheet 44 of a uniform size. Film sheet 44 is sized so as to be less than the length and width of the empty mesh bag and about equal to the length and width of the mesh bag when completely filled with aggregate. The bag of FIG. 3B contains about twice as much aggregate as that of FIG. 3A and thus is about twice as high. Thus, when the two bags lie adjacent each other as in stacks on a truck bed or the like, the worker can readily ascertain the height of the bag even though his vision is limited to a top view, by observing the width of the peripheral extension of the mesh beyond film sheet 44. The wider this extension (dimension T in the top view of FIG. 3A) the smaller the height of the aggregate bag (cf. FIGS. 3A and 3B). This in turn enables the worker to select an aggregate bag of the proper height for placement in the network during its assembly. For example, the aggregate bags 40 adjacent perforated air return line 85 may desirably be four inches in height. However, because of the downward slope of sand fill 42 (note FIG. 2) a more interior row of aggregate bags 40 may desirably be five inches in height and so on, with the bags 40 adjacent plenum 90 desirably being, say, eight inches in height. Therefore, this indexing feature simplifies the work on the construction site. It will also be noted that adjacent aggregate containing bags 40 interface with each other across the open mesh portions at the sides of the bags and that film sheet 44 assists film sheet 50 in confining the air flow within the contained aggregate mass.

Adverting to film sheet 50, it should be appreciated that the film serves several purposes. By enveloping or encasing the overall aggregate mass network the film sheath serves as a barrier against water flowing or seeping into the mass from the surroundings. Secondly, it aids in confining the flow of air to the enlarged continuous void air space partially occupied by the aggregates arranged in the selected network plan. And thirdly, film sheet 50 serves as protective layer for the aggregate during the pouring of the concrete when forming the slab.

It will now be evident that the system of this invention is easy to install. After preparing the site including excavating the perimeter trenches and placing the perimeter insulations 41, 60 therein, sand fill 42 (if used) is graded as desired and the lower plastic film sheeting 50 is placed thereon preferably so that it extends peripherally to the base of the trench for footing 17. The air return line system comprising air return line 85 and its associated parts is put in place together with the network of aggregate containing bags 40 of the proper height interspersed with gravel, sand or earth packs. Plenum 90 and its associated draining system is also installed so that the plenum interfaces with a suitably placed row of bags 40. Upper plastic film sheeting 50 is put in place and the concrete slab 16 and footings 17 are poured.

It should also be evident that the gravel, sand or earth packs may be installed in place by making use, for example, of bags of gravel, sand or earth of suitable size or by pouring or shoveling gravel, sand or earth into appropriately positioned spaces preferably before the network of aggregate containing bags 40 has been installed. As an alternative, the desired network configuration may be excavated into the ground leaving isolated naturally occurring ground packs in place. In all such cases, the lower plastic film sheeting 50 is put in place before installation of bags 40 and thus such sheeting underlies the bags and overlies the packs so that the network channels are lined with plastic film. As a consequence, the flow of air from plenum 90 to return line 85 is biased into and through the aggregate network occupying these channels. In addition, subsequent infiltration of ground water into the aggregate mass does not occur. In all cases, application of the upper film sheet 50 completes the sheathing operation.

When putting the bags 40 in place in the network, it is not necessary that the adjacent interfacing bags actually touch each other—a small amount of spacing between interfacing bags is permissible. However, for best results the interfacing bags will be placed so that they actually abut each other at the interfaces.

It is thought that the invention and many of its attendant advantages will be understood from the foregoing description and it will be apparent that various changes may be made in the form, construction, and arrangement of the parts without departing from the spirit and scope of the invention, the forms hereinbefore described being merely preferred embodiments thereof.

I claim:

1. An aggregate bag air circulation element comprising:

(a) a bag envelope having a top surface, a bottom surface and side surfaces, said bag envelope having openings over at least a portion of its side surfaces, said openings allowing airflow through said bag envelope;

(b) particulate expanded clay aggreate contained within said bag envelope; and (c) indexing means on said bag envelope for indicating the height of said bag envelope from above when said aggreate filled bag envelope rests on a supportive plane-like surface, said indexing means comprising a sheet affixed to said top surface, said sheet being sized so as to be less than the width of the empty bag envelope and about equal to the width of the bag envelope when completely filled with the aggreate whereby the width of the bag envelope extending beyond the periphery of the sheet enables the height of said bag envelope to be ascertained from above when said aggreate filled bag envelope rests on a supportive plane-like surface.

2. The air circulation element of claim 1 wherein said envelope is comprised of at least in part a mesh material.

3. The air circulation element of claim 1 wherein said envelope is a plastic mesh material.

4. The air circulation element of claim 3 wherein said mesh size is on the order of one-quarter inch.

5. The air circulation element of claim 1 wherein said expanded clay aggregate has a total void air space by volume greater than the total volume occupied by individual aggregate particles.

6. In combination, a plurality of aggregate air circulation elements in which each element comprises:

(a) a bag envelope having openings over at least a portion of its surface, said openings being large enough to allow air flow through said bag envelope; and (b) expanded clay aggregate sized to be larger than the openings contained within said bag envelope: said elements being aligned in a row with at least one opening-containing edge of each said element interfacing with an opening-containing edge of an adjacent element to form a continuous duct for air flow, said combination being encased between plastic films that keep water from entering the bags.

7. The combination of claim 6 wherein said elements are alinged on a gently sloping planar surface with successive elements on said sloping planar surface having successively increased heights so that the upper surfaces thereof are generally in a horizontal plane.

8. A four-sided air circulation aggregate bag envelope the sides of which are comprised at least in part of mesh material in which the mesh openings are large enough to act as an air circulation duct, said bag envelope including its mesh material being adapted to contain particulate expanded clay aggregate, and the bag envelope having index sheets of equal size affixed to its top and bottom surfaces: said sheets being sized in length and width so as to be less than the corresponding size of the flattened empty bag envelope whereby the height of the bag envelope containing such aggregate can be visually ascertained from above by observing the width of the peripheral extension of the mesh material beyond the top sheet of the bag envelope.

9. A bag envelope of claim 8 containing said aggregate.

10. A bag envelope of claim 8 in which the mesh material is a plastic mesh material.

11. A bag envelope of claim 8 in which the mesh material is a nylon mesh material.

12. A bag envelope of claim 8 in which the mesh size of the mesh material is on the order of one-quarter inch.

13. A bag envelope of claim 8 in which said sheets are plastic sheets.

14. A bag envelope of claim 8 in which the mesh material is a plastic mesh material and in which said sheets are plastic sheets.

* * * * *